US005516378A

United States Patent [19]

Henry, III et al.

[11] Patent Number: 5,516,378

[45] Date of Patent: May 14, 1996

[54] EXPLOSIVE COMPOSITION AND ITS USE IN MAKING AMMUNITION

[75] Inventors: Guy H. Henry, III, Centralia; Frank M. Bone, Cartville; Matthew S. Solverson, Carbondale, all of Ill.

[73] Assignee: Olin Corporation, Marion, Ill.

[21] Appl. No.: 420,280

[22] Filed: Apr. 11, 1995

[51] Int. Cl.[6] ..... C06B 25/34

[52] U.S. Cl. ..... 149/92; 149/23; 149/88

[58] Field of Search ..... 149/88, 92, 23

[56] References Cited

U.S. PATENT DOCUMENTS

| | | | |
|---|---|---|---|
| 2,124,201 | 7/1938 | Lewis et al. | 149/20 |
| 2,155,499 | 4/1939 | Lawson | 149/4 |
| 3,092,026 | 6/1963 | Williams et al. | 102/455 |
| 3,092,525 | 6/1963 | Cook | 149/2 |
| 3,334,053 | 8/1967 | Audrieth et al. | 252/15.3 |
| 3,599,568 | 8/1971 | Shellnur | 102/455 |
| 3,718,512 | 2/1973 | Hurst | 149/2 |
| 4,202,713 | 5/1980 | Ragon et al. | 149/100 |
| 4,519,855 | 5/1985 | Leneveu et al. | 149/21 |
| 4,841,963 | 6/1990 | Vandeputte | 128/202.15 |
| 4,916,206 | 4/1990 | Day et al. | 528/272 |
| 4,996,923 | 3/1991 | Theising | 102/438 |
| 5,081,930 | 1/1992 | Williams | 102/292 |
| 5,174,837 | 12/1992 | Boileau et al. | 149/19.91 |

*Primary Examiner*—Donald P. Walsh
*Assistant Examiner*—Anthony R. Chi
*Attorney, Agent, or Firm*—Gregory S. Rosenblatt; F. A. Iskander

[57] ABSTRACT

An explosive charge is disclosed for use as ammunition in a casing. The charge is comprised of a particulate propellant which is embedded in a solidified matrix prepared from an energetic liquid composition. The latter comprises a liquid, energetic plasticizer, a polyol and an organic polyisocyanate.

29 Claims, No Drawings

EXPLOSIVE COMPOSITION AND ITS USE IN MAKING AMMUNITION

BACKGROUND OF THE INVENTION

This invention relates generally to ammunition and to an explosive charge for use as ammunition in a casing. In particular, the invention relates to a liquid energetic plasticizer formulation and its use with a granular propellant in making improved explosive charges for small, medium and large-caliber ammunition.

Conventional methods of producing ammunition rounds involve loading an explosive charge of a granular propellant in a casing which may be of the combustible or non-combustible type. Filler materials of various types may be used with the propellant such as to provide a cushioning effect or to hold elongated pieces of explosive in a certain pattern or position within the casing. See for example U.S. Pat. Nos. 3,092,026 to Williams et al, No. 3,599,568 to Shellnut and No. 4,996,923 to Theising.

The use of resinous and other materials, in combination with a particulate propellant, to make composite explosive charges is also well-known in the art. Thus U.S. Pat. No. 2,155,499 to Lawson discloses the concept of rendering water-resistant an explosive composition which is otherwise water-soluble by coating it with a composition made up of a resinous mixed ester of a polyhydric alcohol, a polycarboxylic acid and a fatty acid.

U.S. Pat. No. 2,124,201 to Lewis et al discloses an explosive composition characterized by a relatively high density and a controllable degree of sensitiveness. The composition consists of high density pellets of explosive material, such as ammonium nitrate, surrounded by a mass of a more readily detonable explosive material such as gelatinous dynamite.

U.S. Pat. No. 3,092,525 to Cook discloses a method for molding granular propellant powder grains into consolidated charges in which the identity of the individual grains is maintained. To this end, a sufficient amount of a liquid, relatively non-volatile plasticizer is added to and mixed with a charge of smokeless powder base propellant grains such as to render them tacky, and then the combined charge is subjected to pressure in order to consolidate it into a unitary mass. See also U.S. Pat. No. 5,174,837 to Boileau et al which relates to a process of making fragmentable propellant charges from propellant powder. According to this patent, the propellant particles are sprayed with a coating solution containing dinitropolystyrene, a stabilizer and a polyvinyl nitrate or acetate. This is followed by evaporation of the solvent medium and compression of the coated particles at elevated temperatures.

Finally, U.S. Pat. No. 3,718,512 to Hurst reveals a small cap sensitive explosive composition which is adapted for shipping in commerce as a non-explosive composition consisting of a liquid component and a solid component, the two components being easily mixed together at the use site. For the liquid component, the patent calls for a high energy release explosive which is normally insensitive to small blasting caps. This is mixed at the use site with a predetermined, highly sensitive particulate explosive component such as an alkali metal nitrate.

SUMMARY OF THE INVENTION

The primary object of this invention is to provide an improved explosive charge for use in small, medium and large caliber ammunition. Another object is to enhance the energy output of a granular propellant in a casing without increasing the available casing volume. A further object is to provide an energetic formulation for filling the interstitial voids in a casing which has been filled with granular propellant. Still another object is to provide a method for producing shot cartridges, whereby maximum use is made of the volume available in the cartridge casing. These and other objects will become apparent from following description.

In accordance with the invention, a solidifiable, energetic liquid composition is provided which is used to occupy the interstitial voids in a casing filled with a granular or particulate propellant, thereby yielding improved, more space efficient ammunition. This composition is a formulation comprised of (a) a liquid energetic plasticizer, (b) a polyol, and (c) an organic polyisocyanate.

Further according to the invention, an improved explosive charge is provided, for use as ammunition in a casing, which comprises a particulate propellant embedded in a solidified matrix which is prepared from the liquid energetic composition of the invention.

DETAILED DESCRIPTION

More in detail, the plasticizer used in preparing the solidifiable composition of the invention can be any suitable such material, including mixtures of two or more plasticizers, provided that it is liquid at room temperature and has energetic properties. Illustrative such energetic materials include (a) the variety of nitrate esters such as butanetriol trinitrate (e.g., 1,2,4-butanetriol trinitrate), glycerol trinitrate, ehtylene glycol dinitrate, diethylene glycol dinitrate, triethylene glycol dinitrate, polyethylene glycol dinitrate, butanetriol trinitrate, trimethylolethane trinitrate, propyleneglycol dinitrate, ethylene diamine dinitrate, trimethylolethane trinitrate and mixtures thereof; and (b) the nitramines, such as n-butyl-2 -nitratoethyl-nitramine, ethyl-2-nitratoethyl-nitramine, eutectic blends of n-butyl-2 -nitratoethyl-nitramine or ethyl-2-nitratoethyl-nitramine with methyl-2-nitratoethyl-nitramine, eutectic blends of dinitroxy-diethylnitramine with ethyl-2-nitratoethyl-nitramine, and mixtures thereof.

The liquid energetic plasticizer is employed in a proportion ranging from about 60 to about 92, preferably about 75 to about 90, percent by weight.

Turning now to the polyol component, this must contain at least two terminal hydroxyl groups and preferably should dissolve or blend into the liquid plasticizer such as to form a stable solution. Any suitable such polyol may be used, including the variety of polyether and polyester polyols, e.g., diols, triols and higher functionality polyols and mixtures thereof, as used for example in the production of polyurethanes.

Preferred polyols for use according to the invention are the energetic polyols. Illustrative are glycidol azide polymers and nitramine-containing polymers which are particularly preferred. Illustrative of the latter are the hydroxyl-terminated, nitramine-containing polymers represented by the following empirical structural formula:

$$[(OOCCH_2CH_2—R—CH_2CH_2CO)_x(OOCCH_2CH_2—R'—CH_2CH_2CO)_y(OR'')]_n$$

wherein

R and R' are the same or different moieties selected from the group consisting of —$N(NO_2)$—$N(NO_2)CH_2CH_2N(NO_2)$—, and —$N(NO_2)ZN(NO_2)$—, wherein Z is a linear or branched-chain hydrocarbon radical having 3 to 10 carbon atoms, with the proviso that on average at least one of R and R' per molecule of the polymer is a moiety other than —$N(NO_2)CH_2CH_2N(NO_2)$—; x represents a mole fraction having a value between 0 and 1; y represents a mole fraction equal to 1-x; R" is a linear or branched-chain alkylene or alkylene ether radical having 2 to 12 carbon atoms and having primary or secondary carbon atoms at the radical' points of attachment in the polymer; and n has a value from 2 to 50.

Further details concerning this preferred group of nitramine-containing polymers and their preparation can be found in U.S. Pat. No. 4,916,206, issued Apr. 10, 1990 to R. W. Day et al, the entire disclosure of which is incorporated herein by reference. The most preferred energetic polyol for use according to the invention is hydroxyl-terminated poly(diethyleneglycol-4,8-dinitrazaundeconate), a commercially available product sold under the brand designation "ORP-2" by Olin Corporation of Brandenburg, Ky.

The polyol component of the formulation of the invention is employed in a proportion ranging from about 4 to about 25, preferably about 5 to about 20, percent by weight.

The third essential component of the liquid energetic formulation of the invention is an organic polyisocyanate which reacts with the polyol component to form a polyurethane. Any such chemical having two or more isocyanato groups may be used. This includes for example various aromatic, aliphatic and polymeric isocyanates and mixtures thereof. Illustrative polyisocyanates include toluene diisocyanate, ethylene diisocyanate, propylene diisocyanate, methylene-bis(4-phenyl isocyanate), hexamethylene diisocyanate, isopherone diisocyanate and the polymethylene polyphenylisocyanates. Illustrative of the latter are those described in U.S. Pat. No. 2,683,730, the entire disclosure of which is incorporated herein by reference. In general it is preferable to use an aliphatic polyisocyanate, particularly a diisocyanate, such as hexamethylene diisocyanate and isopherone diisocyanate, alone or in combination with other polyisocyanates.

The proportion of polyisocyanate that is employed in the composition of the invention should generally be sufficient to provide at least 0.7 isocyanato (i.e., NCO) group per each hydroxyl group in the polyol; and in practice, such a proportion of the polyisocyanate is employed as to provide at least about 0.9 NCO, such as from about 0.90 to about 1.20, more preferably about 0.95–1.15, NCO groups per each hydroxyl group.

In addition to the three essential components, it is preferable to include in the formulation of the invention a urethane reaction catalyst to promote the reaction of the polyol with the polyisocyanate and thereby speed up the solidification of the plasticizer formulation after it has been poured into the casing. Any suitable such catalyst may be selected from the variety of urethane reaction catalysts which are known in the art, such as the tertiary amines, the organo-metallic salts, and mixtures thereof. Illustrative tertiary amines include triethylamine, triethylene diamine, N-methylmorpholine and the like; and illustrative organo-metallic salts include the octoates, dilaurates, dioctoates and oleates of tin, titanium, antimony, lead, zinc and so forth. The catalyst or mixture of two or more such catalysts is used in any suitable catalytic proportion such as from about 0.01 to about 1 percent by weight.

It is also highly preferable to include a burn rate catalyst, which, as the name implies, serves to enhance the burn rate of the energetic composition of the invention. Any material which is known to be useful for this purpose may be employed, such as boron or a compound thereof. Further according to the invention, it has been found that a highly effective group of burn rate catalysts is that of the phthalocyanine metal salts such as copper phthalocyanine, which is available commercially from Polyscience Inc. of Warrington, Pa. under the brand name "MONASTRAL BLUE". The use of a burn rate catalyst comprising such a phthalocyanine salt is particularly desirable, if not critical, in connection with making ammunition rounds in accordance with the invention, which can readily be fired at cold temperatures; and pursuant to one preferred embodiment, a combination of two or more burn rate catalysts, one of which is copper phthalocyanine, is included in the composition of the invention.

The burn rate catalyst or mixture of such catalysts may be employed in any suitable catalytic amount such as from about 0.1 to about 2 percent by weight.

Other additives may also be included to serve a particular function or impart a desired effect. For example, in accordance with one embodiment of the invention, it is desirable to include a stabilizer, such as N-methyl p-nitro aniline and this can be used in suitable proportions such as up to 1 percent by weight. Still other additives that may be incorporated in the composition of the invention include carbon black (up to 1% by weight), which serves to absorb heat and thus act as a pacifier, and trimethyl ethyl nitrate (up to about 5% by weight) which serves as an energy booster, if desired.

In practicing the method of the invention, the various ingredients described above are blended together to form a stable solution or a homogeneous suspension. This is then poured into a casing, which has already been loaded with the particulate propellant, in a predetermined amount sufficient to fill the interstitial voids between, and to imbed or envelope, the particles.

The composition or identity of the particulate propellant is not critical. Thus it is contemplated that the method and energetic plasticizer composition of the invention can be used with any solid propellant including for example smokeless Ball Powder® propellant available from Olin Corporation of Brandenburg, Ky. and smokeless powder available from Hercules of Kenville, N.J.

Neither is the shape of the individual particles or bits of the solid propellant critical. Thus, the solid propellant can be in powdered, granular, pelletized, needle-like or other particulate or fragmented form; and accordingly the term "particulate propellant" as used in the specification and claims herein is intended to mean and include any and all such forms and shapes of propellant particles or bits.

Typically, provided it includes a urethane reaction catalyst, the plasticizer formulation will cure in about 12 to 24 hours after it is poured, into a solid matrix with the particulate propellant be imbedded. It will be appreciated that the curing rate varies depending on what particular ingredients and catalysts are used. In those instances where a very fast-curing composition is used, it may be appropriate or necessary to blend together all but the organic isocyanate ingredient, in order to avoid premature curing, the isocyanate being added and blended in just before the plasticizer formulation is to be poured into the cartridge casing.

The use of the energetic plasticizer formulation of the invention in accordance with the method described herein yields a composite ammunition having enhanced energy output without increasing the available casing volume.

Moreover, the plasticizer formulation serves the added function of decreasing the sensitivity of the ammunition, which is a major concern in some applications, thereby contributing to safety.

The following examples are provided to illustrate the invention. In these examples, all parts and percentages are by weight unless otherwise specified.

Example 1

A liquid energetic plasticizer formulation was prepared from the following ingredients in the indicated proportions:

| Ingredients | Weight |
|---|---|
| Butanetriol trinitrate (energetic plasticizer | 87.4 |
| Poly(diethyleneglycol-4,8-dinitrazaundeconate) (polyol) | 10.0 |
| Hexamethylene diisocyanate | 2.0 |
| N-methyl-p-nitroaniline (stabilizer) | 0.4 |
| 3% solution of dibutyltin dilaurate in dimethyl phthalate (urethane reaction catalyst) | 0.2 |

The above ingredients were blended together into a uniform, stable liquid. In each of ten 25 mm shot cartridge cases there were placed 90 grams of Ball Powder® granular propellant No. WC890 followed by 40 grams of the liquid plasticizer formulation. The liquid plasticizer was allowed to cure into a rubbery solid. Each of the cartridges was fired from a 25 mm test gun in a test tunnel where the velocity of the fired bullet was measured at a point 78 feet away from the tip of the gun. The burn time for each bullet was also measured and recorded.

The same firing and testing procedure was repeated using two control bullets, i.e. 25 mm bullets each containing 90 grams of No. WC890 Ball Powder but with no plasticizer added. The results are summarized in the Table below.

Example 2

The procedure of Example 1 was used to prepare and fire-test 4 25 mm bullets. Here however the plasticizer formulation differed slightly from the one used in Example 1. Specifically, instead of 87.4 parts by weight of the butanetriol trinitrate, 86.4 parts were used. Also the formulation in this example included 1.0 part by weight of a borohydride as a burn rate catalyst. The results of this example are provided in the Table below.

TABLE

| | Example 1-2 Results Summary | | |
|---|---|---|---|
| Example No. | Shot No. | Velocity @ 78 ft (meters/second) | Action Time (milliseconds) |
| 1 | 1 | 1128 | 2.13 |
| 1 | 2 | 1131 | 2.83 |
| 1 | 3 | 1148 | 2.83 |
| 1 | 4 | 1154 | 2.58 |
| 1 | 5 | 1173 | 2.84 |
| 1 | 6 | 1156 | 3.02 |
| 1 | 7 | 1137 | 2.96 |
| 1 | 8 | 1153 | 3.00 |
| 1 | 9 | 1154 | 3.00 |
| 1 | 10 | 1120 | 2.33 |
| Control | 1 | 1040 | 3.28 |
| Control | 2 | 1045 | 3.24 |
| 2 | 1 | 1171 | 2.78 |
| 2 | 2 | 1182 | 2.74 |
| 2 | 3 | 1161 | 2.88 |

TABLE-continued

| | Example 1-2 Results Summary | | |
|---|---|---|---|
| Example No. | Shot No. | Velocity @ 78 ft (meters/second) | Action Time (milliseconds) |
| 2 | 4 | 1149 | 3.00 |

While the explosive charge of the invention has been described in terms of ammunition, it may equally be used for rocket motors, fireworks, airbags and other related applications.

It is apparent that there has been provided in accordance with the present invention an energetic binder for an explosive charge that fully satisfies the objects, features and advantages set forth hereinabove. While the invention has been described in combination with embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. An explosive charge, for use as ammunition in a casing, comprising:

a particulate propellant embedded in a solidified energetic matrix which is prepared from a liquid formulation comprised of (a) from about 60 to about 92 percent by weight of a liquid energetic plasticizer, (b) from about 4 to about 25 percent by weight of a polyol having two or more terminal hydroxyl groups, and (c) an organic polyisocyanate having two or more isocyanato groups, in a proportion which is sufficient to provide at least about 0.7 isocyanato group per each hydroxyl group of said polyol.

2. A shot cartridge comprised of a casing containing the explosive charge of claim 1.

3. The explosive charge of claim 1 wherein said liquid formulation includes a urethane reaction catalyst.

4. The explosive charge of claim 3 wherein said liquid formulation also includes a burn rate catalyst.

5. The explosive charge of claim 4 wherein said liquid formulation comprises from about 75 to about 90 percent of said energetic plasticizer, from about 5 to about 20 percent of said polyol and a proportion of said organic polyisocyanate which is sufficient to provide at least about 0.9 isocyanato group per each hydroxyl of said polyol.

6. A shot cartridge comprised of a casing containing the explosive charge of claim 5.

7. The explosive charge of claim 5 wherein said urethane catalyst is dibutyltin dilaurate and said burn rate catalyst comprises copper phthalocyanine.

8. The explosive charge of claim 1 wherein said polyol is an energetic material selected from the group consisting of a glycidol azide polymer, a nitramine-containing polymer and mixture thereof.

9. The explosive charge of claim 8 wherein said polyol is a nitramine-containing polymer represented by the formula:

$$[(OOCCH_2CH_2—R—CH_2CH_2CO)_x(OOCCH_2CH_2—R'—CH_2CH_2CO)_y(OR'')]_n$$

wherein

R and R' are the same or different moieties selected from the group consisting of $—N(NO_2)—$ $N(NO_2)CH_2CH_2N(NO_2)$—, and —$N(NO_2)ZN(NO_2)$—, wherein Z is a linear or branched-chain hydrocarbon radical having 3 to 10 carbon atoms, with the proviso that on average at least one of R and R' per molecule of the polymer is a moiety other than — $N(NO_2)CH_2CH_2N(NO_2)$ x represents a mole fraction having a value between 0 and 1; y represents a mole fraction equal to 1-x; R" is a linear or branched-chain alkylene or alkylene ether radical having 2 to 12 carbon atoms and having primary or secondary carbon atoms at the radical' points of attachment in the polymer; and n has a value from 2 to 50.

10. A shot cartridge comprised of a casing containing the explosive charge of claim 9.

11. The explosive charge of claim 9 wherein said nitramine-containing polymer is poly(diethyleneglycol-4,8-dinitrazaundeconate).

12. The explosive charge of claim 9 wherein said organic polyisocyanate is an aliphatic diisocyanate.

13. The explosive charge of claim 12 wherein said liquid, energetic plasticizer is a nitrate ester or a nitramine.

14. The explosive charge of claim 13 wherein said liquid energetic formulation includes a urethane reaction catalyst and a burn rate catalyst.

15. A shot cartridge comprised of a casing containing the explosive charge of claim 14.

16. The explosive charge of claim 15 wherein said liquid energetic plasticizer is butanetriol trinitrate.

17. The explosive charge of claim 16 wherein said polyol is poly(diethyleneglycol-4,8-dinitrazaundeconate).

18. The explosive charge of claim 17 wherein said organic polyisocyanate is hexamethylene diisocyanate.

19. The explosive charge of claim 18 wherein said burn rate catalyst comprises copper phthalocyanine.

20. A shot cartridge comprised of a casing containing the explosive charge of claim 19.

21. An energetic liquid composition, consisting essentially of:

(a) from about 60 to about 92 percent by weight of a liquid energetic plasticizer;

(b) from about 4 to about 25 percent by weight of a polyol having two or more terminal hydroxyl groups; and (c) an organic polyisocyanate having two or more isocyanato groups, in a proportion which is sufficient to provide at least about 0.7 isocyanato group per each hydroxyl group of said polyol.

22. The energetic liquid composition of claim 21 including a urethane reaction catalyst.

23. The energetic liquid composition of claim 22 also including a burn rate catalyst.

24. The energetic liquid composition of claim 22 wherein said liquid formulation consists essentially of:

from about 75 to about 90 percent, by weight, of said energetic plasticizer;

from about 5 to about 20 percent, by weight, of said polyol; and a proportion of organic polyisocyanate sufficient to provide at least about 0.9 isocyanato group per each hydroxyl of said polyol.

25. The energetic liquid composition of claim 24 wherein said urethane catalyst is dibutyltin dilaurate and said burn rate catalyst is copper phthalocyanine.

26. The energetic liquid composition of claim wherein said polyol is a nitramine-containing polymer represented by the formula $$[(OOCCH_2CH_2—R—CH_2CH_2CO)_x(OOCCH_2CH_2—R'—CH_2CH_2CO)_y(OR'')]_n$$

ps wherein

R and R' are the same or different moieties selected from the group consisting of —$N(NO_2)$—$N(NO_2)CH_2CH_2N(NO_2)$—, and —$N(NO_2)ZN(NO_2)$—, wherein Z is a linear or branched-chain hydrocarbon radical having 3 to 10 carbon atoms, with the proviso that on average at least one of R and R' per molecule of the polymer is a moiety other than —$N(NO_2)CH_2CH_2N(NO_2)$; x represents a mole fraction having a value between 0 and 1; y represents a mole fraction equal to 1-x; R" is a linear or branched-chain alkylene or alkylene ether radical having 2 to 12 carbon atoms and having primary or secondary carbon atoms at the radical' points of attachment in the polymer; and n has a value from 2 to 50.

27. The energetic liquid composition of claim 26 wherein said liquid energetic plasticizer is butanetriol trinitrate.

28. The energetic liquid composition of claim 27 wherein said polyol is poly(diethyleneglycol-4,8-dinitrazaundeconate).

29. The energetic liquid composition claim 28 wherein said organic polyisocyanate is hexamethylene diisocyanate.

* * * * *